US007124798B2

(12) United States Patent
Wild et al.

(10) Patent No.: US 7,124,798 B2
(45) Date of Patent: Oct. 24, 2006

(54) DEVICE FOR FEEDING FOILS FOR THE MANUFACTURE OF FOIL BAGS AND DEVICE FOR THE MANUFACTURE OF FOIL BAGS

(75) Inventors: Hans-Peter Wild, Eppelheim (DE); Eberhard Kraft, Neckarbischofsheim (DE)

(73) Assignee: Indag Gesellschaft Fuer Industriebedarf mbH & Co. Betriebs KG, Eppelheim/Heidelberg (DE)

( * ) Notice: Subject to any disclaimer, the term of this patent is extended or adjusted under 35 U.S.C. 154(b) by 543 days.

(21) Appl. No.: 10/723,484

(22) Filed: Nov. 26, 2003

(65) Prior Publication Data

US 2004/0178296 A1 Sep. 16, 2004

(30) Foreign Application Priority Data

Dec. 2, 2002 (EP) ..... 02026889

(51) Int. Cl.
*B32B 37/00* (2006.01)

(52) U.S. Cl. ..... 156/538; 156/583.1; 242/552

(58) Field of Classification Search ..... 156/538, 156/580, 581, 582, 583.1; 242/418, 418.1, 242/420.6, 552; 226/118.1, 118.2, 118.3
See application file for complete search history.

(56) References Cited

U.S. PATENT DOCUMENTS

| | | | | |
|---|---|---|---|---|
| 3,892,344 | A | 7/1975 | Corse | |
| 3,934,837 | A | 1/1976 | Keilhack et al. | |
| 4,858,842 | A * | 8/1989 | Mundus | 242/413.7 |
| 6,050,517 | A * | 4/2000 | Dobrescu et al. | 242/417.2 |
| 6,340,130 | B1 | 1/2002 | Wild et al. | |
| 2001/0013560 | A1* | 8/2001 | Wild et al. | 242/418.1 |

FOREIGN PATENT DOCUMENTS

| | | |
|---|---|---|
| DE | 19824798 A1 | 12/1999 |
| EP | 0387238 A2 | 2/1990 |
| EP | 0989084 A2 | 3/2000 |
| JP | 52-033231 | 3/1977 |
| JP | 51-072054 | 12/1977 |

(Continued)

OTHER PUBLICATIONS

Japanese Communication dated May 19, 2006.

*Primary Examiner*—James Sells
(74) *Attorney, Agent, or Firm*—Stroock & Stroock & Lavan LLP

(57) ABSTRACT

A device 1 for feeding foil 2 for the manufacture of foil bags with at least one supply roll holder 3 that can be driven with a drive, at least one piece of conveyor equipment 4 for conveying a foil 2 from a supply roll 5 that is held in the supply roll holder 3, at least one foil sensor mechanism 6, which is arranged between the supply roll holder 3 and the conveyor equipment 4, which includes at least one stationary deflection roll 7 and a first and second dancer roll 8, 9, supported in movable supports 10, 11 for turning the foil 2 around, whereby the foil sensor mechanism 6 for regulating the drive of the supply roll holder 3 is formed depending on the distance from the first and/or second dancer roll 8, 9 to the deflection roll 7. The supports 10, 11 of the first and second dancer rolls 8, 9 are hung into at least one hanger 12 that is guided over a deflection wheel 13, 14 and in this way so coupled together that the weight of the first and second dancer rolls 8, 9 is at least partially offset.

11 Claims, 4 Drawing Sheets

FOREIGN PATENT DOCUMENTS

| | | |
|---|---|---|
| JP | 06-003242 | 8/1995 |
| JP | 2000-16653 | 1/2000 |

* cited by examiner

DEVICE FOR FEEDING FOILS FOR THE MANUFACTURE OF FOIL BAGS AND DEVICE FOR THE MANUFACTURE OF FOIL BAGS

FIELD OF THE INVENTION

The invention relates to a device for feeding foils for the manufacture of foil bags as well as to a device for the manufacture of foil bags.

BACKGROUND OF THE INVENTION

Machines of this kind are known from DE 198 247 98 (U.S Pat. No. 6,340,130).

A width of foil is rolled off of a supply roll, turned around a stationary deflection roll and a dancer roll that is supported in a way that allows it to move, and forwarded by a take-off device. From this it is also known to use two dancer rolls that are securely coupled to one another. The dancer roll serves to regulate the unrolling of the width of foil from the supply roll.

The weight of the dancer rolls places a load on the width of foil in this connection and consequently stretches it, which has proven to be detrimental. The weight of the dancer roll can be considerable. This is particularly detrimental in the processing of thin foils, which, for example, because of their elasticity properties or their stretching capability, withstand only limited tensile stress. Furthermore, it has proven to be detrimental that the dancer rolls move only by jerks and jolts, which results in uncontrolled tensile stress and thereby in uncontrolled stretching of the foil. This is particularly detrimental in the manufacture of foil bags, in which case the foils are processed with precisely specified lengths.

SUMMARY OF THE INVENTION

The object of the present invention is therefore to provide a device for feeding foil for the manufacture of foil bags, with which the unrolling of the foil from the supply roll can be regulated, without subjecting the foil to high levels of or uncontrolled tensile stress. Furthermore, the provision of a device for the manufacture of foil bags that includes an improved device for feeding the foil is an object of the invention.

These objects are solved in accordance with the present device for feeding foil for the manufacture of foil bags and a device for the manufacture of foil bags.

In accordance with the invention, on a device for feeding the foil for the manufacture of foil bags, the supports of the first and second dancer rolls are hung into a flexible hanger, which is guided via at least one deflection wheel, so that the weight of the first and second dancer rolls is at least partially offset.

By means of this coupling, movement of the dancer rolls is possible, so that the unrolling of the foil from the supply roll can be regulated. Simultaneously, the dancer rolls with their weight hang on the opposite ends of a flexible hanger, so that their weight is at least partially or completely offset and their weight does not cause any or only limited tension in the foil and consequently no stretching of the same. Furthermore, the coupling of the dancer rolls via the flexible hanger allows a movement of the dancer rolls with limited jerks and jolts, because they can be put into motion reciprocally.

A device for the manufacture of foil bags according to the invention includes at least two devices according to the invention for feeding the foil and a heat-sealing device for heat-sealing the two foils. Foil bags are manufactured during the heat-sealing. Because one foil can include a pattern of a front side of a foil bag to be manufactured and the other foil can hold a pattern of the back side, it is essential that the two foils be brought together precisely into a predetermined relative position of the two patterns. Because with the device for feeding the foil according to the invention a high level of or uncontrolled stretching of the foil is prevented, the accuracy of the fit when the foils are brought together is easily possible. The manufacture of foil bags is consequently simplified. It is also possible for one or more additional foils to be fed and heat-sealed, such as a bottom foil, which can be punctured and folded and inserted between the two foils.

BRIEF DESCRIPTION OF THE DRAWINGS

In the following, an embodiment of the device according to the invention is explained with the help of the enclosed figures. Shown by the figures are:

FIG. 1 shows a device for feeding foil for the manufacture of foil bags.

DETAILED DESCRIPTION OF THE INVENTION

Figure 1:
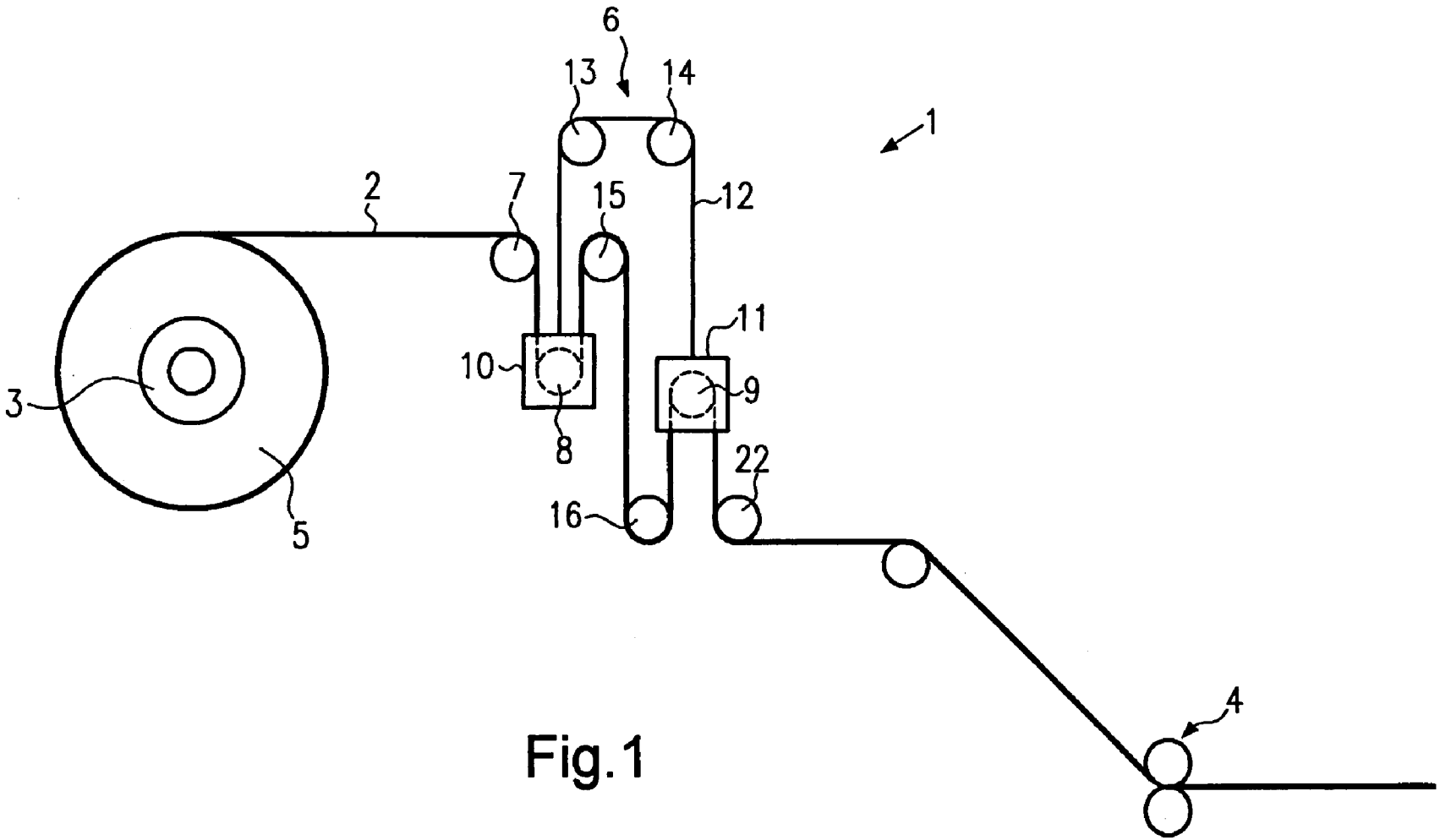
FIG. 1 a schematic representation of a device for feeding foils.

A foil supply roll 5 is held in a supply roll holder 3 that can be driven with a drive. A foil 2 is depicted rolled off of the foil supply roll 5.

A foil sensor mechanism 6 is arranged downstream from the supply roll 5. The foil sensor mechanism 6 includes several deflection rolls, 7, 15, 16, 22 and two dancer rolls 8, 9. The deflection and dancer rolls 7, 8, 9, 15, 16, 22 are arranged in such a way that the foil 2 is turned around, alternating from the top and from the bottom, in the order from the first deflection roll 7, the first dancer roll 8, the second deflection roll 15, the third deflection roll 16, the second dancer roll 9 and the fourth deflection roll 22. Arranged downstream from the foil sensor mechanism 6 is a conveyor equipment 4 consisting of two rolls, at least one of which is driven, whereby the two rolls of the conveyor equipment 4 work together in such a way that they take up and convey the foil 2 between them.

A conveyor equipment can also be arranged further downstream than the rolls 4, so that the rolls 4 serve only as deflection rolls that are not driven.

The deflection rolls 7 and 15 are arranged at roughly the same height. This same is true for the deflection rolls 16 and 22. The dancer roll 8 can move between the heights of the deflection rolls 7 and 16. Correspondingly, the dancer roll 9 can move between the heights of the deflection rolls 15 and 16. The dancer rolls 8, 9 can move along vertical guides, whereby the vertical guides are not depicted in FIG. 1.

The dancer roll 8 is arranged in a hanging foil loop that is open at the top. The dancer roll 9 is provided in a foil loop that is open at the bottom. The foil loop of the dancer roll 9 is held up by the dancer roll 9.

The bearing 10 of the first dancer roll 8 and the bearing 11 of the second dancer roll 9 are coupled together via a belt 12, which is turned around deflection wheels 13, 14. The weights of the bearings 10 and 11, as well as of the first and second dancer rolls 8, 9, each hang on the respective flexible hanger 12. In this way, the dancer rolls 8, 9 do not strain the foil 2 with their weight.

Because the weight of the dancer rolls 8, 9 is neutralized, the dancer roll 8, for example, can be slightly pre-tensioned by a weight, spring, rubber cord, rubber band, a combination thereof or the like without noticeably or permanently stretching the foil 2. In this way, slight tension can be generated in the foil 2, which holds the foil 2 tightly between the separate rolls. Because of the neutralisation of the dancer roll weights and the controlled provision of a slight tension, the foil tension can be set to any level, so that even thin and sensitive foils can be processed.

The deflection wheels 13, 14 of the hanger are arranged at roughly the same height. The hanger 12 is arranged horizontally between the two deflection wheels 13 and 14. In addition to the deflection wheels 13 and 14, the hanger 12 runs vertically along the dancer roll guide.

Figure 2B:
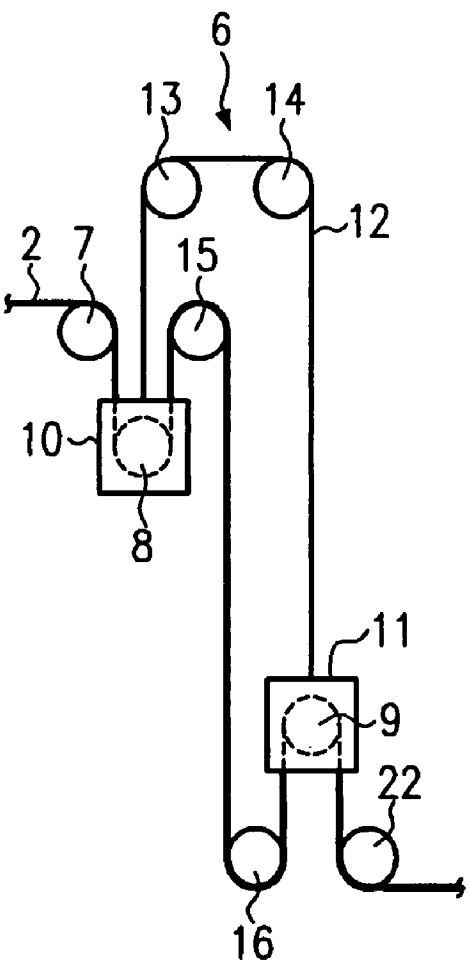
FIG. 2*a* and FIG. 2*b* each, a schematic representation of a foil sensor mechanism from a device for feeding foil.
Figure 2A:
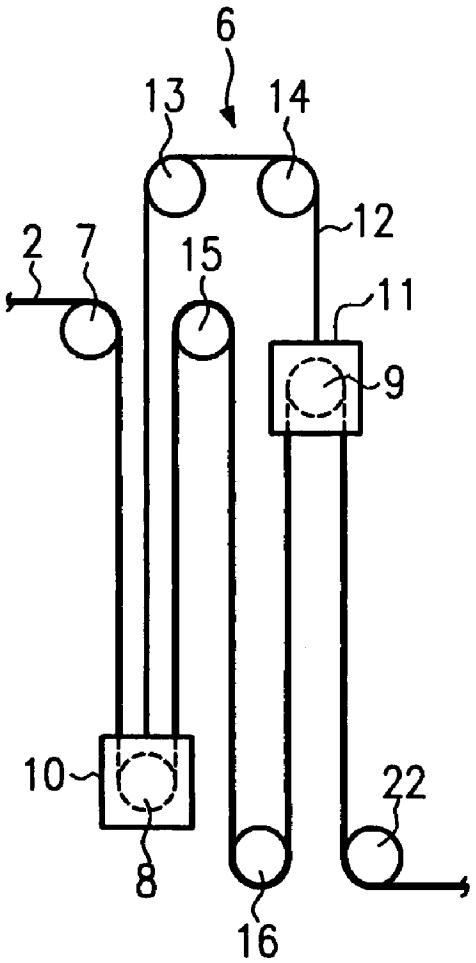

The functioning of the foil sensor mechanism is explained with regard to FIGS. 2*a*, 2*b*. FIG. 2*a* depicts a state in which the foil sensor 6 has taken up a large amount of foil. The first dancer roll 8 is at a large distance from the deflection roll 7, so that a lot of foil is available between the deflection roll 7 and the first dancer roll 8 and between the first dancer roll 8 and the deflection roll 15. In this case, the dancer roll 8 with the bearing 10 is in a lower position. The dancer roll 9 with the bearing 11 is simultaneously at a large distance from the deflection roll 16, so that there is also a large amount of foil material taken up between the deflection roll 16 and the dancer roll 9, as well as between the dancer roll 9 and the deflection roll 22. In this case, the dancer roll 9 and the bearing 11 are in an upper position.

If now less foil 2 is fed to the foil sensor mechanism 6 than is taken up, the dancer roll 8 with the bearing 10 will move upward and the dancer roll 9 with the bearing 11 will move downward. In this way, because the bearing 10 and the bearing 11 are coupled to one another via the hanger 12, both dancer rolls can start moving synchronously. lowering the dancer roll 9 with the bearing 11, the bearing 10 with the dancer roll 8 will be raised because of the coupling via the hanger 12. In this way, both the path between the deflection roll 16 and the dancer roll 9, the path between the dancer roll 9 and deflection roll 22 and additionally the path between the deflection roll 7 and the dancer roll 8 and the dancer roll 8 and the deflection roll 15 are shortened. In this way, a lot of foil material can simultaneously be conveyed out of the foil sensor mechanism without jerky and jolting movement.

After a certain time, when more foil material has been conveyed away from the foil sensor mechanism than was conveyed in, the configuration as depicted in FIG. 2*b* results. In this case, little foil material is taken up in the foil sensor mechanism 6. The first dancer roll 8 is close to the first deflection roll 7, so that there is little foil between the deflection roll 7 and the first dancer roll 8, as well as between the first dancer roll 8 and the deflection roll 15. At the same time, the dancer roll 9 is close to the deflection roll 16 and the deflection roll 22, so that there is also little foil material available between the deflection roll 16, the dancer roll 9 and the deflection roll 22. In this case, the first dancer roll 8 is in an upper position and the second dancer roll 9 is in a lower position. In this way, because the first and second dancer rolls 8 and 9 are connected to one another via the bearings 10 and 11 and via the flexible hanger 12, both dancer rolls 8 and 9 have moved synchronously. In just the same way that the dancer roll 9 has drawn closer to the deflection roll 16, the dancer roll 8 has drawn closer to the deflection roll 7.

With the configuration shown in FIG. 2*a*, the drive of the drivable supply roll holder 3 from FIG. 1, which delivers the foil 2 to the foil sensor mechanism 6, is retarded, so that less foil material is fed to the foil sensor mechanism 6. In this way, the state in FIG. 2*b* will occur after a certain time with constant conveying away from the foil sensor mechanism 6. In this state, the drive of the drivable supply roll holder 3 is accelerated, so that more foil material is fed into the foil sensor mechanism 6.

While the foil runs from the first deflection roll 7 to the fourth deflection roll 22 in FIG. 1 and FIG. 2, the foil sensor mechanism can also be inserted in the opposite direction. This means that the foil 2 runs over the deflection roll 22 into the foil sensor mechanism 6, is consequently first turned around towards the top, then runs over the dancer roll 9, the deflection rolls 16 and 15 to the dancer roll 8 and finally to the deflection roll 7, where the foil 2 leaves the foil sensor mechanism.

Figure 3:
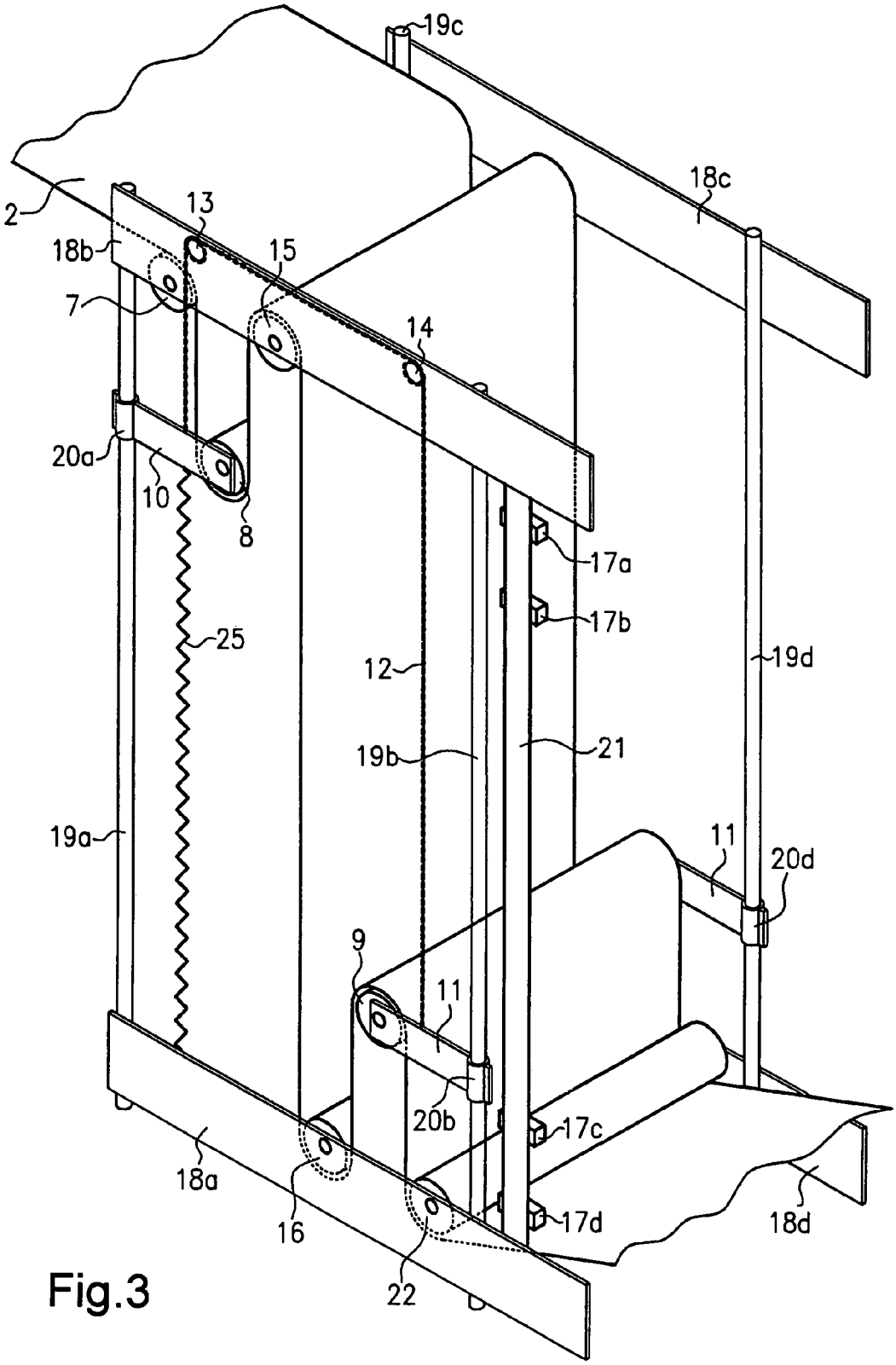
FIG. 3 a three-dimensional schematic representation of a foil sensor mechanism from a device for feeding foil.

FIG. 3 shows a detailed embodiment of the foil sensor mechanism. The foil sensor mechanism has a frame made of the horizontally positioned elements 18*a*, 18*b*, 18*c* and 18*d*. Elements 18*a* and 18*b* are connected via the vertical rods 19*a* and 19*b*. The horizontal elements 18*c* and 18*d* are connected to one another via the vertical rods 19*c* and 19*d*. The deflection rolls 7 and 15 are arranged between the upper horizontal elements 18*b* and 18*c*. The deflection rolls 16 and 22 are arranged between the lower horizontal elements 18*a* and 18*d*. The deflection rolls 7, 15, 16 and 22 are stationary and held in a way that allows them to rotate.

A slide bearing 20*a* is provided on the vertical rod 19*a*, with the bearing 10 attached to it, so that the bearing 10 is supported in a movable way and can move up and down along the rod 19*a*. The bearing 10 is a bearing for the first dancer roll 8. Not depicted in FIG. 3 because it cannot be seen in the perspective view, a comparable slide bearing 20*c* is provided on the rod 19*c*, with which the bearing is supported on the other end of the dancer roll 8 in a way that allows it to move.

Two slide bearings 20*b* and 20*d* are arranged on the vertical rods 19*b* and 19*d*, one on each, that support the bearing 11 for support of the second dancer roll 9. The dancer roll 9 on the bearings 11 can be moved up and down along the vertical rods 19*b* and 19*d* via the slide bearings 20*b* and 20*d*. The bearings 10 and 11 are coupled together via a toothed belt 12, whereby the toothed belt 12 is guided via the guiding gear wheels 13 and 14. While only one toothed belt 12 is depicted in FIG. 3, the backward bearings shown in FIG. 3, for example, the bearings attached to the slide bearings 20*c*, 20*d*, can also be connected to each other via a second toothed belt.

The bearing 10 of the dancer roll 8 is pre-tensioned downwards by a spring 25, by means of which a slight foil tension is achieved in a controlled way.

In FIG. 3, four sensors 17*a*, 17*b*, 17*c* and 17*d* are depicted, which serve to detect the position of the second dancer roll 9 or its bearing 11 or the slide bearing 20*b*. If the sensor 17*c* detects the dancer roll 9 close to it, the drive of the drivable supply roll holder can be accelerated and if the second sensor from the top 17*b* detects the dancer roll 9, the drive can be retarded. If the sensor 17*a* or 17*d*, i.e., the sensor at the very top or the sensor at the very bottom, detects the dancer roll 9, the device for the manufacture of foil bags can be switched off altogether.

Instead of detection of the dancer roll 9, sensors can also be provided for the detection of the position of the dancer roll 8. It is also possible to bring in sensors for the detection of the rotation of the deflection wheels 13, 14 or for registering their current rotational position, in order to regulate the drive of the drivable supply roll holder, because when there is a change in the position of the dancer rolls 8, 9, the deflection wheels 13, 14 are rotated.

Figure 4:
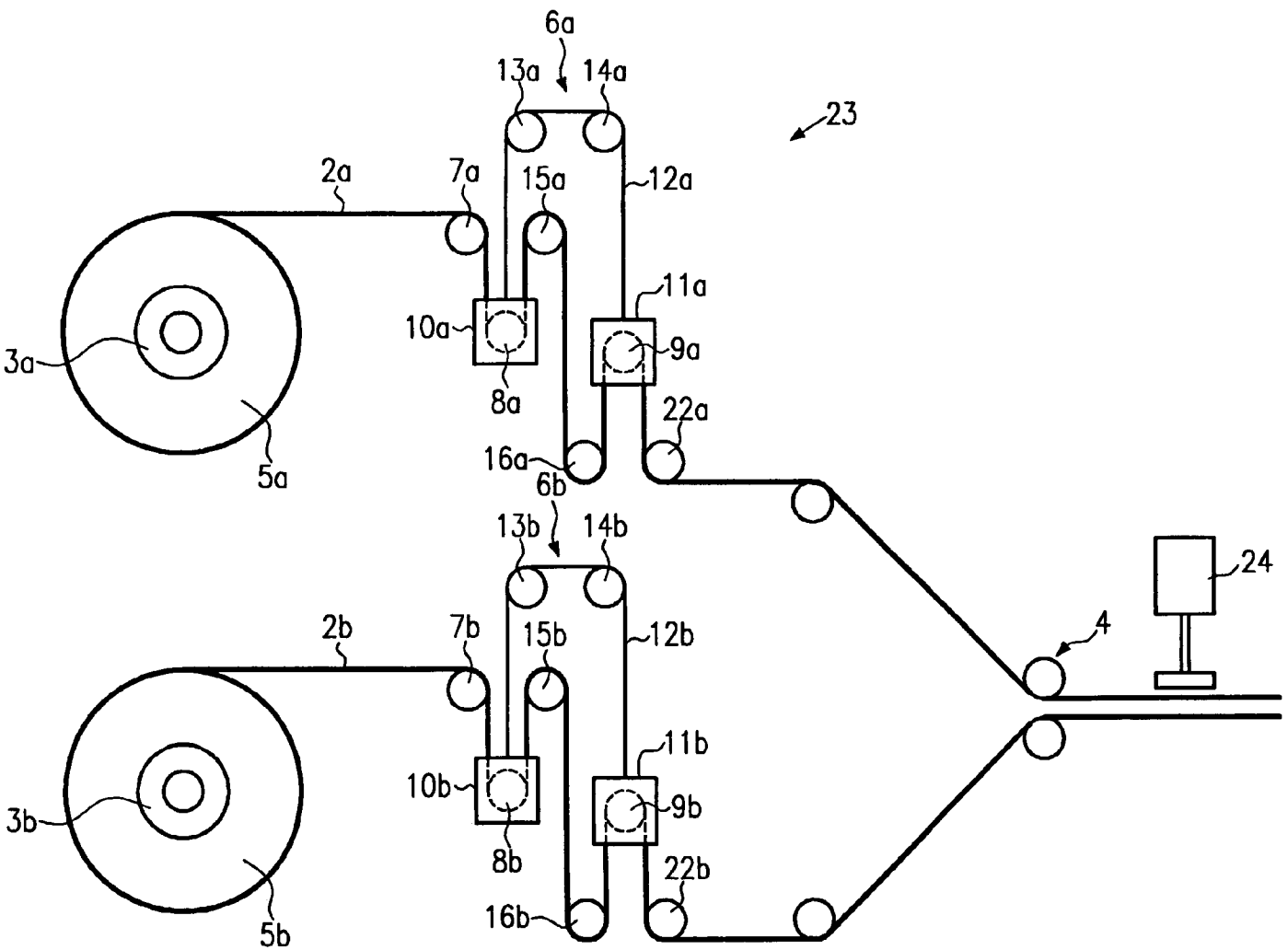
FIG. 4 a schematic representation of a device for the manufacture of foil bags.

FIG. 4 depicts a device 23 for the manufacture of foil bags. The device includes a first and second device for feeding foil 2*a*, 2*b*, whereby the conveyor equipment 4 feeds both foils 2*a*, 2*b* together. The device furthermore includes a heat-sealing device for heat-sealing the foils 2*a*, 2*b* into foil bags. The reference numbers used in the preceding figures identify the same elements in FIG. 4, whereby an "a" is appended to each of the reference numbers for the first device for feeding foil 2*a* and a "b" is appended for the second device for feeding foil 2*b*. The functioning and design of the first and second devices for feeding foil are the same as for the devices depicted in FIG. 1 through FIG. 3, except that the conveyor equipment 4 belongs to both devices for feeding foil. For this reason, no detailed description is necessary.

The foil 2*a*, which is fed by the first device for feeding foil, and the foil 2*b*, which is fed by the second device for feeding foil, are laid on top of one another by the conveyor equipment 4. The foils 2*a*, 2*b* that have been laid on top of one another in this way are heat-sealed into foil bags by the heat-sealing device 24, which includes one or more heat-insert sealing jaws. It is also possible to insert a bottom foil between the foils 2*a* and 2*b*, so that stand-up foil bags can be manufactured.

If the rolls 4 depicted in FIG. 4 are not the conveyor equipment but are instead (non-driven) deflection rolls, the conveyor equipment can also be arranged downstream from the heat-sealing device 24.

We claim:

1. Device (1) for feeding foil (2, 2*a*, 2*b*) for the manufacture of foil bags comprising:

at least one supply roll holder (3, 3*a*, 3*b*) that can be driven with a drive;

at least one piece of conveyor equipment (4) for conveying a foil (2, 2*a*, 2*b*) from a supply roll (5, 5*a*, 5*b*), the supply roll (5, 5*a*, 5*b*) being held in the supply roll holder (3, 3*a*, 3*b*);

at least one foil sensor mechanism (6, 6*a*, 6*b*) which is arranged between the supply roll holder (3, 3*a*, 3*b*) and the conveyor equipment (4), the at least one foil sensor mechanism (6, 6*a*, 6*b*) including at least one stationary deflection roll (7, 7*a*, 7*b*) and, as held in movable supports (10, 10*a*, 10*b*, 11, 11*a*, 11*b*), a first and second dancer roll (8, 8*a*, 8*b*, 9, 9*a*, 9*b*) for turning the foil (2, 2*a*, 2*b*) around;

the at least one foil sensor mechanism (6, 6*a*, 6*b*) for regulating the drive of the supply roll holder (3*a*, 3*b*) is formed in dependence on the distance from one of the first and the second dancer roll (8, 8*a*, 8*b*, 9, 9*a*, 9*b*) to the deflection roll (7, 7*a*, 7*b*), and the moveable supports (10, 10*a*, 10*b*, 11, 11*a*, 11*b*) of the first and second dancer rolls (8, 8*a*, 8*b*, 9, 9*a*, 9*b*) are hung into at least one flexible hanger (12, 12*a*, 12*b*) that is guided via a deflection wheel (13, 13*a*, 13*b*, 14, 14*a*, 14*b*) and so coupled together that the weights of the first and second dancer rolls (8, 8*a*, 8*b*, 9, 9*a*, 9*b*) are at least partially offset.

2. Device according to claim 1, wherein the first dancer roll (8, 8*a*, 8*b*) is arranged in a foil loop that is open to the top and the second dancer roll (9, 9*a*, 9*b*) in a foil loop that is open to the bottom.

3. Device according to claim 1, wherein the first dancer roll (8, 8*a*, 8*b*) is arranged in a foil loop that is open to the bottom and the second dancer roll (9, 9*a*, 9*b*) in a foil loop that is open to the top.

4. Device according to claim 1, wherein the flexible hanger (12, 12*a*, 12*b*) is given by one of a belt, toothed belt, rubber belt, a line, cord, chain, ribbon, rope or a combination thereof.

5. Device according to claim 1, wherein the flexible hanger (12, 12*a*, 12*b*) is a toothed belt and the deflection wheel (13, 13*a*, 13*b*, 14, 14*a*, 14*b*) is a toothed wheel.

6. Device according to claim 1, and at least two additional stationary deflection rolls (15, 15*a*, 15*b*, 16, 16*a*, 16*b*) are arranged between the first and second dancer rolls (8, 8*a*, 8*b*, 9, 9*a*, 9*b*).

7. Device according to claim 1, wherein at least one of the first and second dancer rolls (8, 8*a*, 8*b*, 9, 9*a*, 9*b*) is pre-tensioned by a weight, an elastic pretension element, a spring, a rubber band, a rubber cord.

8. Device according to claim 1, and sensors (17*a*, 17*b*, 17*c*, 17*d*) for the detection of the position of the first and second dancer roll (8, 8*a*, 8*b*, 9, 9*a*, 9*b*).

9. Device according to claim 1, and sensors for the detection of the position of the dancer rolls are provided on the deflection wheel.

10. Device (23) for the manufacture of foil bags comprising:

a heat-sealing device (24) for heat-sealing of at least two foils (2*a*, 2*b*); and at least two devices for feeding the two foils (2*a*, 2*b*), each foil feeding device including:

at least one supply roll holder (3, 3*a*, 36) that can be driven with a drive;

at least one piece of conveyor equipment 4 for conveying a foil (2, 2*a*, 2*b*) from a supply roll (5, 5*a*, 5*b*), the supply roll (5, 5*a*, 5*b*) being held in the supply roll holder (3, 3*a*, 3*b*);

at least one foil sensor mechanism (6, 6*a*, 6*b*) which is arranged between the supply roll holder (3, 3*a*, 3*b*) and the conveyor equipment (4), the at least one foil sensor mechanism (6, 6*a*, 6*b*) including at least one stationary deflection roll (7, 7*a*, 7*b*) and, held in movable supports (10, 10*a*, 10*b*, 11, 11*a*, 11*b*), a first and second dancer roll (8, 8*a*, 8*b*, 9, 9*a*, 9*b*) for turning the foil (2, 2*a*, 2*b*) around;

the at least one foil sensor mechanism (6, 6*a*, 6*b*) for regulating the drive of the supply roll holder (3*a*, 3*b*) is formed in dependence on the distance from one of the first and the second dancer roll (8, 8*a*, 8*b*, 9, 9*a*, 9*b*) to the deflection roll (7, 7*a*, 7*b*), and the moveable supports (10, 10*a*, 10*b*, 11, 11*a*, 11*b*) of the first and second dancer rolls (8, 8*a*, 8*b*, 9, 9*a*, 9*b*) are hung into at least one flexible hanger (12, 12*a*, 12*b*) that is guided via a deflection wheel (13, 13*a*, 13*b*, 14, 14*a*, 14*b*) and so coupled together that the weights of the first and second dancer rolls (8, 8*a*, 8*b*, 9, 9*a*, 9*b*) are at least partially offset.

11. Device according to claim 10, wherein the conveyor equipment (4) is formed for conveying both foils (2*a*, 2*b*).

* * * * *